US005255903A

United States Patent [19]

Parsons et al.

[11] Patent Number: 5,255,903

[45] Date of Patent: Oct. 26, 1993

[54] SHEET FEED AND ALIGNMENT APPARATUS

[75] Inventors: Michael H. Parsons, Rochester; Steven M. Russel, Pittsford, both of N.Y.

[73] Assignee: Eastman Kodak Company, Rochester, N.Y.

[21] Appl. No.: 997,155

[22] Filed: Dec. 23, 1992

Related U.S. Application Data

[63] Continuation of Ser. No. 790,794, Nov. 12, 1991, abandoned.

[51] Int. Cl.[5] ..... B65H 5/00

[52] U.S. Cl. ..... 271/10; 271/118; 271/119; 271/124; 271/127; 271/236; 271/245; 271/250

[58] Field of Search ..... 271/10, 118, 119, 121, 271/124, 126, 127, 236, 245, 250, 251

[56] References Cited

U.S. PATENT DOCUMENTS

| | | | |
|---|---|---|---|
| 3,593,988 | 7/1971 | Collins | 50/2 |
| 3,861,670 | 7/1975 | Kraft | 50/2 |
| 3,888,479 | 6/1975 | Eder et al. | 50/2 |
| 3,933,350 | 6/1976 | Mignano | 50/2 |
| 3,980,296 | 9/1976 | Craft et al. | 50/2 |
| 4,221,374 | 9/1980 | Koch et al. | 50/2 |
| 4,426,150 | 1/1984 | Matsumoto et al. | 355/321 |
| 4,461,465 | 7/1984 | Hartman et al. | 271/121 |
| 4,918,490 | 4/1990 | Stemmle | 355/308 |

FOREIGN PATENT DOCUMENTS

| | | | |
|---|---|---|---|
| 85457 | 8/1983 | European Pat. Off. | 271/251 |
| 162445 | 9/1983 | Japan | 271/126 |
| 183535 | 10/1983 | Japan | 271/126 |
| 74843 | 4/1988 | Japan | 271/121 |
| 123729 | 5/1988 | Japan | 271/119 |
| 294133 | 11/1989 | Japan | 271/119 |

*Primary Examiner*—H. Grant Skaggs
*Attorney, Agent, or Firm*—Leonard W. Treash, Jr.

[57] ABSTRACT

A sheet feeding apparatus in which a stack of sheets is supported and stored in a biased base tray. Successive uppermost sheets contained within the biased base tray are caused to move into engagement with a segmented feed roller. A cone shaped roller in combination with edge guides provide cross-track, in-track and skew alignment for the uppermost sheet after is it separated and advanced from the stack by the segmented feed roller. A biased retard pad prevents multiple sheet feeds from the stack.

10 Claims, 3 Drawing Sheets

SHEET FEED AND ALIGNMENT APPARATUS

This is a continuation of application Ser. No. 790,794 filed Nov. 12, 1991 now abandoned.

BACKGROUND OF THE INVENTION

Sheet feeding apparatus having mechanisms for supporting, separating and advancing single sheets in seriatim are most commonly used in the printing, recording and copying fields.

It is well known that the separation and seriatim advancing of sheets from a stack or pile of sheets presents many problems due to the differences in size, weight, stiffness and surface characteristics of the sheets. Moreover, the characteristics of the sheets will vary depending upon humidity and electrostatic conditions.

Various types of sheet feeding systems have heretofore been utilized in the printing, recording and copying fields, such as the following which have been summarized in U.S. Pat. No. 3,861,670 issued on Jan. 21, 1975 to William A Kraft:

> A system that utilizes feed rollers mounted pivotably and biased into engagement with an uppermost sheet of a stack of sheets. The feed rollers cooperate with drag pads engaging a side edge of the stack to insure that only the uppermost sheet is fed from the stack;
>
> a system that utilizes feed rollers pivoted into engagement with an uppermost sheet of a stack and snubbers securing the leading edge of the stack;
>
> a system that utilizes vacuum feed arms or adhesive rollers operating in conjunction with an elevating sheet tray to pick up a top sheet from a stack of sheets and advance it into a set of feed rollers; and
>
> a system that utilizes a stationary feed roller cooperating with a retard roller, biased into engagement therewith or spaced therefrom, and a nudger roller or endless belt that is biased against an uppermost sheet of a stack of sheets.

The disadvantages of the above systems, as respectively stated in the Kraft patent, are that they rely heavily upon sheet strength, sheet stiffness, sheet weight and approach angle to the feed nip which, if not consistent, may mar or notch the paper.

While the Kraft patent claims to have overcome the disadvantages of the prior art, a disadvantage of the Kraft system is the lack of a simple copy sheet aligning feature.

In U.S. Pat. No. 4,426,150, issued on Jan. 17, 1984 to Hiroshi Matsumoto and Tomoki Ogura, there is disclosed an original document feed and aligning apparatus having an incline roller for guiding an original document, both toward a stop lever and along a lateral edge of the apparatus for in-track, cross track and skew alignment. Nowhere in this patent, however, is there any disclosure of a means for preventing multiple feeding of the original document. In addition, the feeding and alignment system is complex, requiring many interconnecting gears and shafts to accomplish alignment.

From the above, it is apparent that numerous approaches have been attempted to obtain reliable separation and seriatim advancing of a sheet from a stack of sheets. However, none of the approaches combines a sheet aligning system for cross-track, in-track and skew alignment that is simple and reliable with a practical means for preventing multiple sheet feeds.

SUMMARY OF THE INVENTION

A sheet feeding and aligning apparatus comprises tray means containing a biased platform for supporting a stack of sheets. A controlling means for positioning the biased platform for loading and feeding the sheets. The uppermost sheet, from the stack of sheets, is fed by a feed means while a retard means prevents all but the uppermost sheet from being feed by the feed means. A first aligning means aligns the uppermost sheet in cross-track and skew alignment, and a second aligning means, in cooperation with the first aligning means, aligns the uppermost sheet in in-track alignment.

It is an object of the present invention to provide a compact feeding apparatus that has a minimal number of parts but which provides cross-track, in-track and skew alignment while preventing multiple sheet feeds as it separates and advances the uppermost sheet from a stack of sheets.

The above and other objects, as well as advantages of the invention, will become apparent from the following description of the preferred embodiment as described in conjunction with the accompanying drawings.

DESCRIPTION OF THE PREFERRED EMBODIMENT OF THE INVENTION

In describing the preferred embodiment of the instant sheet feeding and aligning apparatus, reference is made to the drawings wherein like numerals indicate like parts and structural features in the various views, diagrams and drawings. For the sake of discussion, but not limitation, the preferred embodiment of the present invention will be described in relation to a photocopying apparatus.

Figure 1:
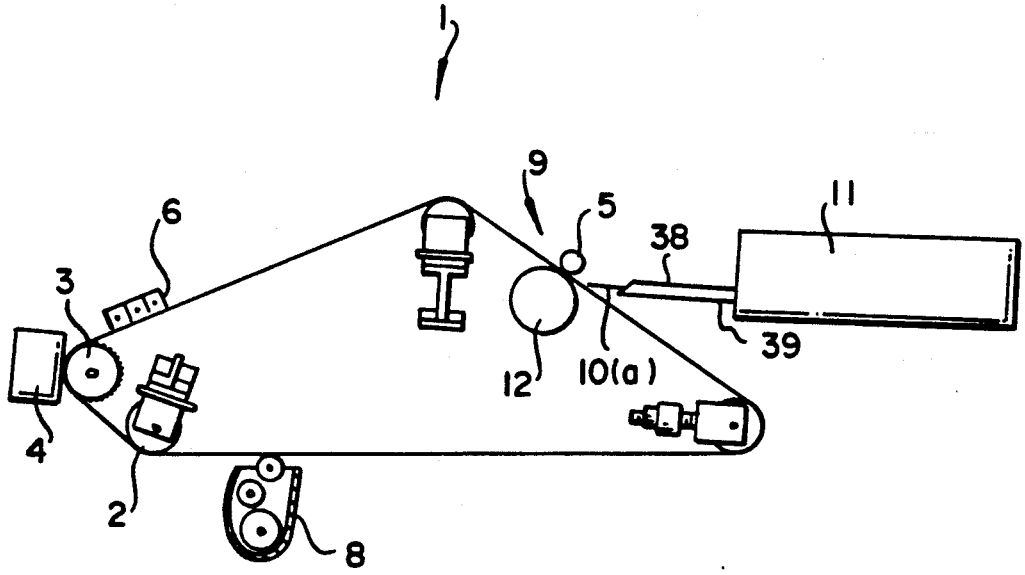
FIG. 1 is a schematic side view of a photocopying apparatus in accordance with the present invention, but with parts eliminated for clarity of illustration.

As shown in FIG. 1, a film core portion 1 of an image-forming apparatus includes an endless movable belt, such as an electrophotographic belt 2, entrained about a series of rollers to maintain substantially equal tension, cross-track movement and alignment of belt 2 throughout its travel. As known in the art, roller 3 is an imaging roller for an LED printhead 4, and roller 5 is a back up rener for belt 2.

Belt 2 passes through a series of electrophotographic stations, generally well-known in the art. More specifically, a uniform charge is laid down on belt 2 at a charging station 6. The uniformly-charged belt 2 moves around imaging roller 3 directly opposite LED printhead 4 which exposes belt 2 in a manner well-known in the art. Belt 2 then moves into operative relationship with a toning station 8, where the image created by exposure using LED printhead 4 is toned. The now toned image proceeds to a transfer station 9 where the image is transferred to a transfer surface, such as a copy sheet 10(*a*), that has been delivered by a copy sheet feeding apparatus 11 to transfer station 9.

Transfer station 9 includes a transfer drum 12, which cooperates with belt 2, to incrementally bring sheet 10(*a*) and the toned image into transfer relation for transferring the toned image to sheet 10(*a*).

Figure 3:
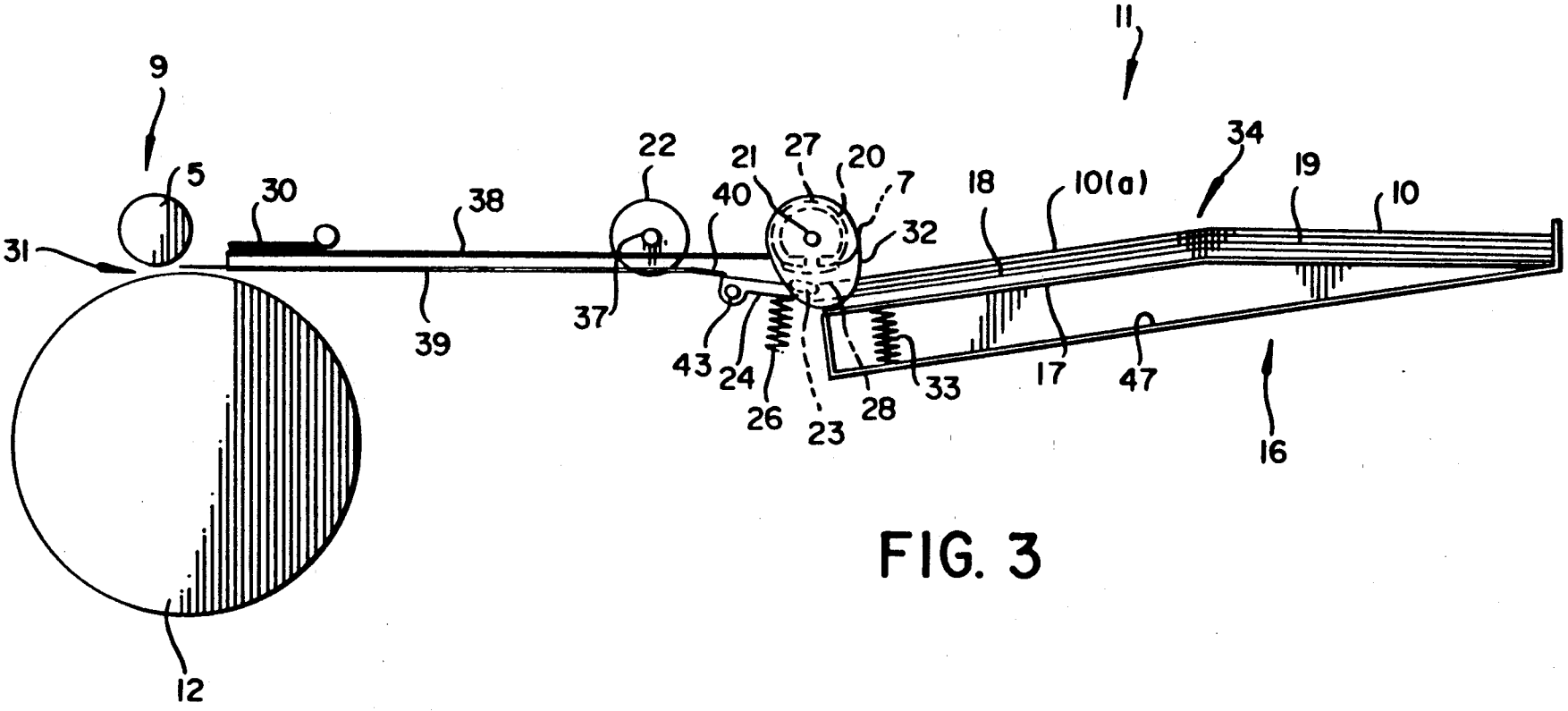
FIG. 3 is a side view of the sheet feeding apparatus in accordance with the present invention.
Figure 5:
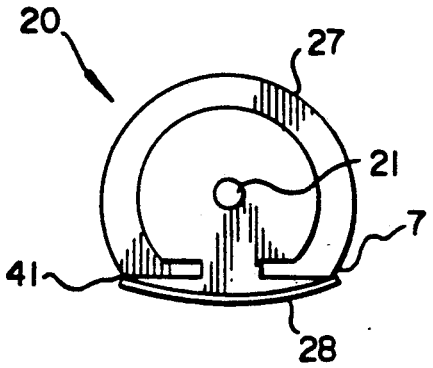
FIG. 5 is an enlarged view of a segmented feed roller in accordance with the present invention.

As shown in FIG. 3, a tray 16 of copy sheet feeding apparatus 11 has a spring platform 17 upon which copy sheets 10 are stacked and stored. Biased base tray 16 has a base 44 on which a spring 33 is mounted to urge spring platform 17 upwards. Copy sheets 10, when placed on spring platform 17, conform to a forward 18 and a reverse 19 taper of spring platform 17. By having a forward taper 18, the front portion of the uppermost sheet 10(*a*) remains in conforming relation to spring platform 17 and in proper position for separation and feeding. If it were not for taper 18, the front portion of sheet 10(*a*) would have a tendency to rise up and out of proper separation and feeding position as platform 17 is urged upward, by spring 33, as the supply of sheets 10 contained within tray 16 is depleted by use. The urging of spring platform 17 upward, by spring 33, causes the uppermost sheet 10(*a*), of copy sheet stack 34, to make tangential contact with the leading edge 7 of a segmented scuff feed roller 20, see FIG. 5.

Figure 2:
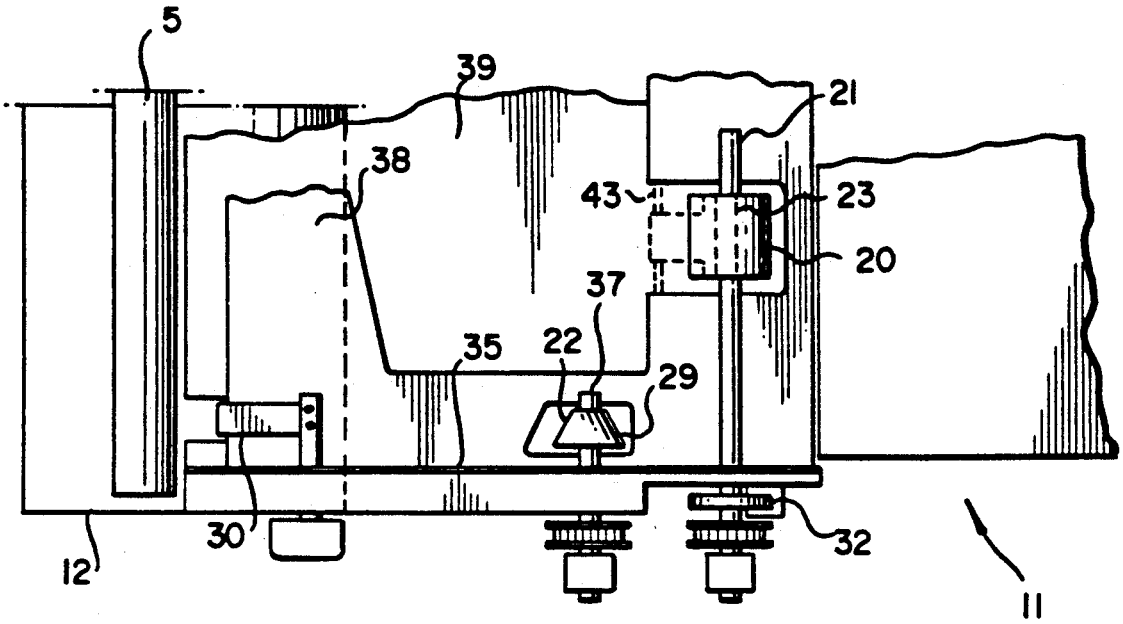
FIG. 2 is a top view of a sheet feeding apparatus in accordance with the present invention.
Figure 4:
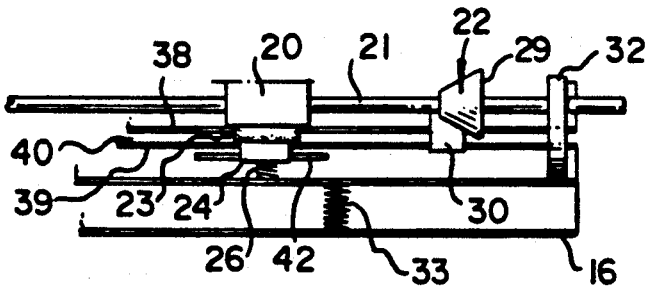
FIG. 4 is a front view of the sheet feeding apparatus in accordance with the present invention.

As shown in FIGS. 2 and 4, scuff feed roller 20 and a position controlling means for spring platform 17, such as a cam 32, are mounted for rotation with a shaft 21, driven by a motor, not shown, but known in the art. At the beginning of each revolution of scuff feed roller 20, the leading edge 7 of an arc portion 27, see FIGS. 3 and 5, of scuff feed roller 20 makes rotational driving contact with the then uppermost sheet 10(*a*) of stack 34. As arc portion 27 rotates, in frictional contact over uppermost sheet 10(*a*), it drives uppermost sheet 10(*a*) forward through a nip 25, see FIG. 6, formed by scuff feed roller 20 and a retard pad 23 and over a lower guide plate 38 and under an upper guide plate 39. This forward drive, by scuff feed roller 20, continues until arc portion 27, of scuff feed roller 20, rotates out of a position adjacent to and in contact with sheet 10(*a*). When arc portion 27 rotates out of its position adjacent to and in contact with sheet 10(*a*), a flat portion 28, of feed roller 20, rotates into the position adjacent to, but out of contact with sheet 10(*a*). At this poise% leading edge 42, of sheet 10(*a*), makes contact with a cone shaped edge guide roller 22 which becomes the new driving force for sheet 10(*a*).

Figure 6:
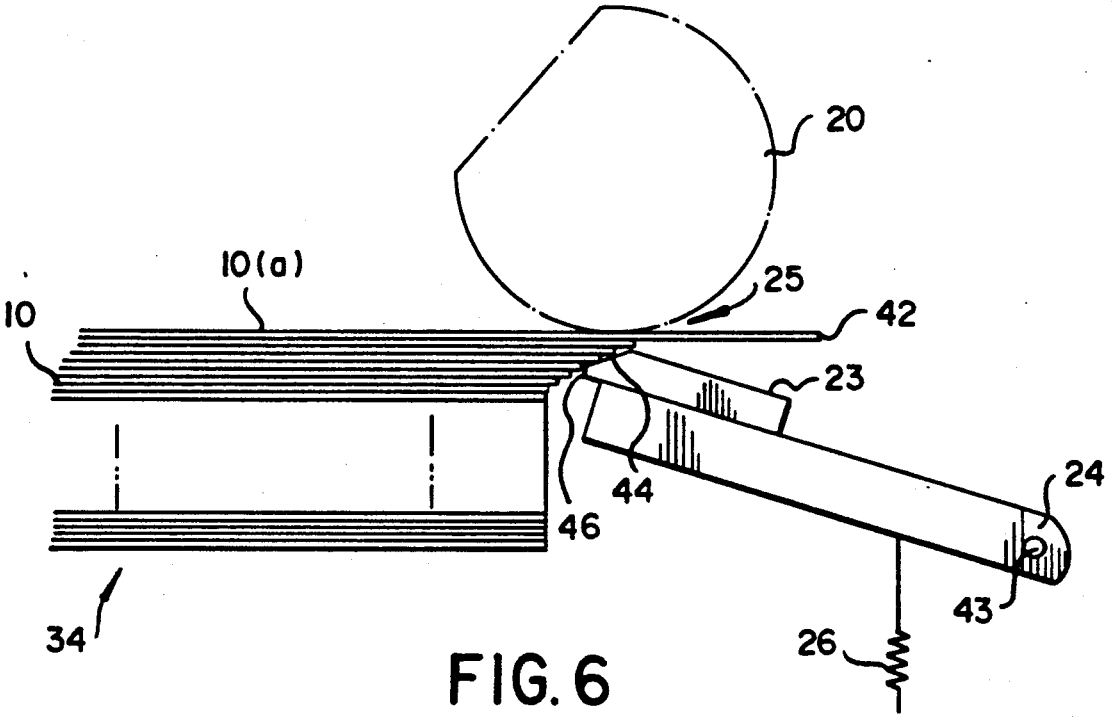
FIG. 6 is an enlarged side view of a portion of the sheet feeding apparatus in accordance with the present invention, but with parts eliminated for clarity of illustration.

As sheet 10(*a*) is fed, by scuff feed roller 20, toward edge guide roller 22, the remaining copy sheets 10, located in stack 34, are prevented from forward movement by retard pad 23. Retard pad 23, as shown in FIGS. 3 and 6, is mounted on a retard lever 24 which pivots about a pivot mount 43 secured to sheet feeding apparatus 11. The leading edge 46 of retard pad 23 has a taper 44 allowing sheets 10 to be fanned out, as shown in FIG. 6, adjacent taper 44 of retard pad 23. This fanning out of sheets 10 partially separates sheets 10, prior to the feeding process, and thereby lessens the chance of multiple feeds.

In addition to the above-mentioned partial separation of sheets 10, by taper 44, the position of retard pad 23 is controlled, through spring 26, so that if two sheets enter into nip 25, formed between retard pad 23 and scuff feed roller 20, retard pad 23 will firmly retard any sheet located in stack 34 that is below uppermost sheet 10(*a*). Uppermost sheet 10(*a*), due to coefficient of friction differences between scuff feed roller 20, retard pad 23 and sheets 10, as explained below, slides over the sheet located below it, in stack 34, as it is fed by feed roller 20 into nip 25. This sliding and feeding is possible, since the coefficient of friction for both scuff roller 20 and retard pad 23 is high, usually in excess of 1.5, while the coefficient of friction for sheets 10 is comparatively low, such as 1.0.

In addition to the retarding force exerted on sheets 10, by spring 26, through retard pad 23, an additional retarding force is generated by any force applied to retard pad 23 that is parallel to the path of travel of sheet 10(*a*). Since these parallel forces tend to rotate retard lever 24 about pivot mount 43 located downstream of retard pad 23, thereby causing retard pad 23 to apply a greater retarding force to the sheet located below sheet 10(*a*) in stack 34. This additional retarding force is described in U.S. Pat. No. 5,007,627, issued on Apr. 16, 1991 to John Giannetti, Jerry F. Sieve and Robert H. Shea.

As shown in FIG. 2, edge guide roller 22, upon entering into driving engagement with sheet 10(*a*), urges sheet 10(*a*), because of the cone shape of edge guide rener 22, with the largest portion 29 of the cone adjacent a lateral guide edge 35, both forward and laterally toward lateral guide edge 35. This urging of sheet 10(*a*) laterally toward lateral guide edge 35 and forward through a space 40, formed by lateral guide edge 35, lower guide 38 and upper guide 39, results in a lateral edge of sheet 10(*a*) moving into engagement with lateral guide edge 35. Once the lateral edge of sheet 10(*a*) makes contact with lateral guide edge 35, edge guide roller 22, because it is constructed of a soft compliant material, such as foam rubber, cannot overcome the retarding force that lateral guide edge 35 places on the lateral edge of sheet 10(*a*). Therefore, once the lateral edge of sheet 10(*a*) engages lateral guide edge 35, edge guide roller 22 is no longer capable of driving sheet 10(*a*) in a lateral manner and edge guide roller 22 slips on sheet 10(*a*) in the lateral direction. The slipping of edge guide roller 22 on sheet 10(*a*) in the lateral direction, however, causes a gentle jogging of sheet 10(*a*) in the lateral direction which, in turn, causes the lateral edge of sheet 10(*a*) to move into parallel relationship with lateral guide edge 35. Upon sheet 10(*a*) obtaining this parallel relationship with lateral guide edge 35, sheet 10(*a*) is then in proper cross-track and skew alignment with an image that is to be later transferred to sheet 10(*a*). Buckling of sheet 10(*a*), both in the lateral and forward directions, is prevented during this feeding process by space 40 being large enough not to interfere with the travel of sheet 10(*a*), but restrictive enough to prevent sheet 10(*a*) from buckling, for example in the range of $\frac{1}{8}$ to $\frac{1}{2}$ inches. In addition, by eliminating any horizontal seams, in space 40, where lateral guide edge 35, lower guide 38 and upper guide 39 meet, roll up of sheet 10(*a*) is prevented. With the elimination of buckling and roll up, as above stated, the system is less reliant upon sheet strength and stiffness.

In-track alignment of sheet 10(*a*) is accomplished by the interaction of edge guide roller 22, sheet 10(*a*), lateral guide edge 35 and an alignment gate 30. Alignment gate 30 is located perpendicular to lateral guide edge 35 and downstream of edge guide roller 22. Forward movement of sheet 10(*a*), along lateral guide edge 35 and toward alignment gate 30, is caused by the frictional contact, of sheet 10(*a*), with rotating edge guide roller 22 and the force of gravity on sheet 10(*a*). Once leading edge 42, of sheet 10(*a*), reaches alignment gate 30, edge guide roller 22, again because of its construction of foam rubber, can not overcome the retarding force that alignment gate 30 places on leading edge 42 of sheet 10(*a*). Therefore, once leading edge 42, of sheet 10(*a*), reaches alignment gate 30, edge guide roller 22 is no longer capable of driving-sheet 10(*a*) forward and edge guide roller 22 slips on the top surface of sheet 10(*a*). The slipping of edge guide roller 22 on sleet 10(*a*), however, causes a gentle jogging of sheet 10(*a*) in the forward direction which, in turn, causes leading edge 42, of sheet 10(*a*), to position itself parallel to alignment gate 30. Once this parallel alignment with alignment gate 30 is accomplished, sheet 10(*a*) is in in-track, cross-track and skew alignment and positioned to be fed to image transfer nip 31, see FIG. 6. At transfer nip 31 the leading edge 42 of sheet 10(*a*) meets the leading edge of the image to be transferred to sheet 10(*a*).

Since cone-shaped edge guide roller 22 is mounted for continuous rotation with a mounting shaft 37, the need for a complex drive system with clutches, idler rollers and idler springs, as in the prior art, is eliminated. In addition, since shaft 37 is mounted at the lateral guide edge 35, where sheet 10(*a*) is fed by scuff feed roller 20, shaft 37 is short, for example extending 1⅛ to 3 inches past lateral guide edge 35, see FIG. 2, and, therefore, it does not require a complex shaft support and gearing mechanism, as used in the prior art. With the elimination of complex drive systems, long shafts and the problems they cause, the present sheet feeding and aligning apparatus can be made compact, simple, and reliable.

As shown in FIG. 3, when scuff feed roller 20 is in its non-feed mode, i.e., flat surface 28 being adjacent sheets 10, cam 32 maintains spring platform 17 in a position away from scuff feed roller 20 for ease of loading spring platform 17 with sheets 10. In addition, once sheet 10(*a*) makes initial contact with scuff feed roller 20 and sheet 10(*a*) is being fed by scuff feed roller 20, cam 32, because of its shape and rotation with scuff feed roller 20, maintains sheets 10, contained on spring platform 17, removed from scuff feed roller 20, thereby reducing the possibility of any sheet, in stack 34, below uppermost sheet 10(*a*), from being feed by scuff feed roller 20. In addition, cam 32 prevents sheets 10 or platform 17 from urging sheet 10(*a*) into contact with flat section 28 of scuff feed roller 20, thereby preventing flat section 28 from interfering with the feeding of sheet 10(*a*) by edge guide roller 22. In other words, the control means regulates engagement of the sheets so that only the uppermost sheet engages the feed means.

Briefly stated, in operation, sheets 10 are maintained in tray 16 of sheet feeding apparatus 11. Uppermost sheet 10(*a*), of sheet stack 34, is caused to move forward from stack 34 by frictional contact with segmented scuff feed roller 20. Retard pad 23, in biased cooperation with a portion of scuff feed roller 20, prevents all but uppermost sheet 10(*a*), in stack 34, from advancing during each rotation of scuff feed roller 20.

Rotation of scuff feed roller 20 overdrives uppermost sheet 10(*a*) past retard pad 23, through nip 25, formed by scuff feed roller 20 and retard pad 23, and into engagement with continuously rotating cone-shaped edge guide roller 22. Once engagement between sheet 10(*a*) and edge guide roller 22 is established, scuff feed roller 20 relinquishes frictional contact with sheet 10(*a*).

Upon contact being established between sheet 10(*a*) and edge guide roller 22, edge guide roller 22 drives sheet 10(*a*) forward toward alignment gate 30 and laterally toward lateral guide edge 35 of sheet feeding apparatus 11. The lateral movement of sheet 10(*a*) continues until the lateral edge of sheet 10(*a*) makes contact with lateral guide edge 35. This contact with lateral guide edge 35 prevents sheet 10(*a*) from further lateral movement and causes edge guide roller 22 to slip on sheet 10(*a*) in a lateral direction. As a result of edge guide roller 22 slipping on sheet 10(*a*) in a lateral direction, the lateral edge of sheet 10(*a*) is caused to be gently jogged into a parallel relationship with lateral guide edge 35. In this manner, edge guide roller 22, in conjunction with lateral guide edge 35 of sheet feeding apparatus 11, performs cross-track and skew alignment of sheet 10(*a*).

The forward movement of sheet 10(*a*) in contact with lateral guide edge 35 of sheet feeding apparatus 11 continues until leading edge 42 of sheet 10(*a*) makes contact with alignment gate 30. The contact with alignment gate 30 prevents sheet 10(*a*) from further forward movement and causes edge guide roller 22 to slip on sheet 10(*a*).

As a result of edge guide roller 22 slipping on sheet 10(*a*), leading edge 42, of sheet 10(*a*), is caused to be gently jogged into a parallel relationship with alignment gate 30. Once leading edge 42 of sheet 10(*a*) is in parallel contact with alignment gate 30, in-track alignment of sheet 10(*a*) is achieved. With the achievement of in-track alignment, coupled with the previously discussed cross-track and skew alignment, sheet 10(*a*) is totally aligned.

Sheet 10(*a*) is retained in total alignment, by alignment gate 30 and lateral guide edge 35, until a signal is received that the image to be transferred to sheet 10(*a*) is positioned for transfer to sheet 10(*a*). Upon receipt of that signal, alignment gate 30 is lifted. With the lifting of alignment gate 30, forward movement of sheet 10(*a*) is no longer restricted by alignment gate 30, and forward driving engagement between edge guide roller 22 and sheet 10(*a*) is resumed. This causes sheet 10(*a*) to move forward and leading edge 42 of sheet 10(*a*) to make contact with transfer nip 31. At transfer nip 31, leading edge 42 of sheet 10(*a*) meets the leading edge of the image to be transferred and transfer of the image to sheet 10(*a*) begins.

While the present invention has been described with reference to the particular structure disclosed herein, it is not intended that it be limited to the specific details, and this application is intended to cover such modifications or changes as may come within the purposes or scope of the claims forming a part hereof.

We claim:

1. A sheet feeding and aligning apparatus comprising:

tray means;

a biased platform for supporting a stack of sheets within the tray means;

feed means having a uniform surface for parallel feeding an uppermost sheet from the stack of sheets;

control means for regulating engagement of the sheets with the feed means;

retard means in pivotal contact with the stack of sheets for preventing other than the uppermost sheet from being fed from the stack of sheets;

a first aligning means having a continuously rotating continuous surface cone-shaped roller rotating about an axis which forms an angle of 90° with the longitudinal path of the uppermost sheet for aligning the uppermost sheet in cross-track and skew alignment; and a second aligning means, in cooperation with the first aligning means, for aligning the uppermost sheet is in-track alignment.

2. The sheet feeding and aligning apparatus of claim 1 wherein the biased platform is arranged so that the uppermost sheet of the stack is urged into frictional contact with the feed means.

3. The sheet feeding and aligning apparatus of claim 2 wherein the feed means comprises a segmented roller of generally D-shaped cross section and means for rotating the segmented feed roller through a complete revolution.

4. The sheet feeding and aligning apparatus of claim 3 wherein the means for rotating the segmented feed roller through a complete revolution simultaneously rotates the controlling means through a complete revolution to regulate engagement of the sheets with the feed means.

5. The sheet feeding and aligning apparatus of claim 4 wherein the retard means forms a nip with the segmented feed roller to prevent feeding of other than the uppermost sheet through said nip.

6. The sheet feeding and aligning apparatus of claim 5 wherein the retard means includes:

a retard pad;

a retard lever upon which the retard pad is mounted; and a pivot mount about which the retard lever rotates.

7. The sheet feeding and aligning apparatus of claim 5 wherein the first aligning means includes a lateral guide edge for restricting lateral movement of the uppermost sheet.

8. The sheet feeding and aligning apparatus of claim 7 wherein the second alignment means includes:

the continuously rotating cone shaped roller;

the lateral guide edge; and an alignment gate for restricting forward movement of the uppermost sheet.

9. The sheet feeding and aligning apparatus of claim 8 wherein the biased based platform includes a forward and a reverse taper.

10. A sheet feeding and aligning apparatus comprising:

tray means;

a biased platform for supporting a stack of sheets within the tray means;

a segmented roller of generally D-shaped cross-section for parallel removing an uppermost sheet from the stack of sheets and feeding said uppermost sheet;

control means for positioning the biased platform such that there is engagement of the uppermost sheet with the segmented roller;

retard means for preventing other than the uppermost sheet from being fed from the stack of sheets;

a first aligning means having a continuously rotating continuous surface cone-shaped roller rotating about an axis which forms an angle of 90° with the longitudinal path of the uppermost sheet for aligning in cross-track and skew alignment the uppermost sheet fed to said first aligning means by the segmented roller; and a second aligning means, in cocperation with the first aligning means, for aligning the uppermost sheet in in-track alignment.

* * * * *

UNITED STATES PATENT AND TRADEMARK OFFICE

CERTIFICATE OF CORRECTION

PATENT NO. : 5,255,903

DATED : October 26, 1993

INVENTOR(S) : Michael H. Parsons, Steven M. Russel

It is certified that error appears in the above-indentified patent and that said Letters Patent is hereby corrected as shown below:

Column 7, line 4, delete "is" and substitute --in--.

Signed and Sealed this

Twenty-sixth Day of April, 1994

*Attest:*

Bruce Lehman

BRUCE LEHMAN

*Attesting Officer*

*Commissioner of Patents and Trademarks*